US011222599B2

(12) United States Patent
Kim et al.

(10) Patent No.: US 11,222,599 B2
(45) Date of Patent: Jan. 11, 2022

(54) SOURCE DRIVER AND DISPLAY DEVICE INCLUDING THE SAME

(71) Applicant: Silicon Works Co., Ltd., Daejeon (KR)

(72) Inventors: Seong Geon Kim, Daejeon (KR); Young Bok Kim, Daejeon (KR); Won Kim, Daejeon (KR)

(73) Assignee: Silicon Works Co., Ltd.

( * ) Notice: Subject to any disclaimer, the term of this patent is extended or adjusted under 35 U.S.C. 154(b) by 0 days.

(21) Appl. No.: 17/186,416

(22) Filed: Feb. 26, 2021

(65) Prior Publication Data

US 2021/0272525 A1 Sep. 2, 2021

(30) Foreign Application Priority Data

Feb. 28, 2020 (KR) ..... 10-2020-0024760

(51) Int. Cl.
*G09G 3/3275* (2016.01)

(52) U.S. Cl.
CPC ... *G09G 3/3275* (2013.01); *G09G 2300/0828* (2013.01); *G09G 2320/0295* (2013.01)

(58) Field of Classification Search
CPC ..... G09G 2310/027; G09G 2320/029; G09G 2320/0295; G09G 3/3275; G09G 3/3283; G09G 2310/0294; G09G 2320/0233; G09G 2320/04; G09G 2320/043
See application file for complete search history.

(56) References Cited

U.S. PATENT DOCUMENTS 9,542,873 B2 * 1/2017 Yu ..... G09G 3/006
10,249,248 B2 * 4/2019 Lee ..... G09G 3/3258

FOREIGN PATENT DOCUMENTS

| | | | |
|---|---|---|---|
| KR | 2017-0064162 | A | 6/2017 |
| KR | 2018-0015571 | A | 2/2018 |
| KR | 2018-0061884 | A | 6/2018 |
| KR | 2019-0079826 | A | 7/2019 |
| KR | 2020-0005347 | A | 1/2020 |
| KR | 2020-0056687 | A | 5/2020 |

* cited by examiner

*Primary Examiner* — Koosha Sharifi-Tafreshi
(74) *Attorney, Agent, or Firm* — Polsinelli PC

(57) ABSTRACT

A source driver and a display device including the same, capable of accurately sensing pixels characteristics and characteristics of the source driver. A source driver includes a switch circuit configured to transfer first pixel signals or reference signals; first sensing channels configured to sense and hold the first pixel signals or the reference signals transferred from the switch circuit; second sensing channels configured to sense and hold second pixel signals; and a selection circuit configured to output a sampling signal by selecting the first pixel signals of the first sensing channels and the second pixel signals of the second sensing channels, and thereafter, output the sampling signal by selecting the reference signals of the first sensing channels.

15 Claims, 2 Drawing Sheets

SOURCE DRIVER AND DISPLAY DEVICE INCLUDING THE SAME

BACKGROUND

1. Technical Field

Various embodiments generally relate to a display device, and more particularly, to a source driver and a display device including the same, capable of accurately sensing pixels characteristics and characteristics of the source driver.

2. Related Art

In general, a display device includes a display panel, a source driver and a timing controller.

The source driver converts image data, provided from the timing controller, into a source signal and provides the source signal to the display panel, so as to display an image on the display panel. Such a source driver may be integrated as one chip, or may be configured by a plurality of chips in consideration of a size and a resolution of the display panel.

In order to sense pixels characteristics of pixels of the display panel, the source driver senses pixel signals of the pixels by using pixel sensing channels, converts the pixel signals into digital data, and provides the digital data to the timing controller.

However, not only the pixel characteristics but also characteristics of the source driver are included in the digital data.

In the conventional art, in order to compensate for the characteristics of the source driver, the characteristics of the source driver are sensed by using additional sensing channels. If there are no additional sensing channels, it is difficult to accurately obtain the characteristics of the source driver at an actual pixel sensing time, because a time of sensing the pixels and a time of sensing the characteristics of the source driver are different from each other and a temperature of the chip changes over time.

In the conventional art, since the additional sensing channels are used, there is a problem in that a chip area of the source driver increases, and since mismatches exist between the pixel sensing channels and the additional sensing channels, there is a problem in that the characteristics of the source driver cannot be accurately obtained.

That is to say, the conventional art has a problem in that a change in the characteristics of the source driver depending on a temperature cannot be accurately compensated for on image data.

SUMMARY

Various embodiments are directed to a source driver and a display device including the same, capable of accurately sensing pixels characteristics and characteristics of the source driver.

In an embodiment, a source driver may include: a switch circuit configured to transfer first pixel signals or reference signals; first sensing channels configured to sense and hold the first pixel signals or the reference signals transferred from the switch circuit; second sensing channels configured to sense and hold second pixel signals; and a selection circuit configured to output a sampling signal by selecting the first pixel signals of the first sensing channels and the second pixel signals of the second sensing channels, and thereafter, output the sampling signal by selecting the reference signals of the first sensing channels, wherein the switch circuit transfers the reference signals to the first sensing channels after the sampling signal corresponding to the first pixel signals and the second pixel signals is started to be converted into digital data.

In an embodiment, a display device may include: a display panel; and a source driver connected to the display panel through sensing lines, wherein the source driver senses first pixel signals and second pixel signals transferred through the sensing lines, and converts the first pixel signals and the second pixel signals into digital data; senses reference signals transferred through the sensing lines after the first pixel signals and the second pixel signals are started to be converted into the digital data; and converts the reference signals into the digital data after the first pixel signals and the second pixel signals are converted into the digital data.

As described above, since the embodiments sense not only pixel characteristics but also characteristics of a source driver by using sensing channels for sensing the pixel characteristics, it is possible to accurately compensate for, on image data, a change in the characteristics of the source driver depending on a temperature.

Also, since the embodiments do not require an additional sensing channel for sensing the characteristics of the source driver, it is possible to reduce a chip area of the source driver.

In addition, the embodiments may eliminate mismatches between pixel sensing channels and channels for sensing the characteristics of the source driver.

DETAILED DESCRIPTION

A source driver and a display device including the same embodied by the present disclosure may be configured to accurately sense a change in characteristics of the source driver depending on a temperature, by using pixel sensing channels.

In embodiments, the characteristics of the source driver may be defined as including characteristics of sensing channels and characteristics of an analog-to-digital converter that change depending on a temperature of a chip or an external factor. For example, an offset and a gain may be exemplified as the characteristics of the sensing channels and the analog-to-digital converter.

In the embodiments, a display period may be defined as a period in which a source signal corresponding to image data is provided to a display panel, and a sensing period may be defined as a period in which pixel characteristics are detected by sensing pixel signals from pixels of the display panel.

The embodiments may operate in an initialization mode, a programming mode and a sensing mode. The initialization mode may be defined as an operation of initializing the pixels, the programming mode may be defined as an operation of programming the pixels with a reference signal after the initialization mode, and the sensing mode may be defined as an operation of sensing the pixel characteristics and the characteristics of the source driver after the programming mode.

Figure 1:
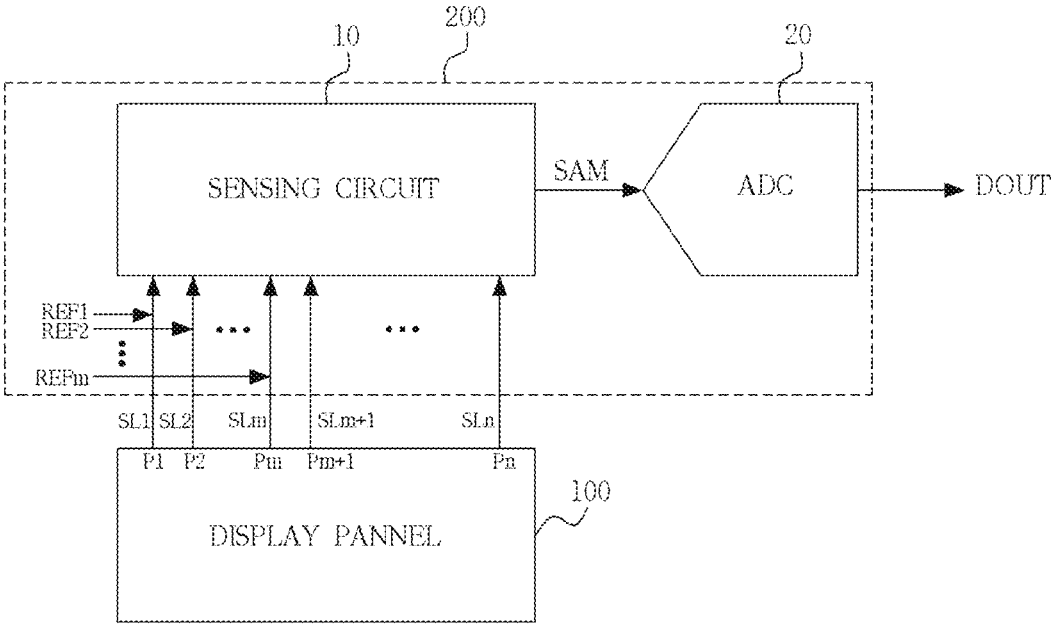
FIG. 1 is a block diagram of a display device in accordance with an embodiment.

FIG. 1 is a block diagram of a display device including a source driver in accordance with an embodiment.

Referring to FIG. 1, the display device includes a display panel 100 and a source driver 200.

The display panel 100 includes data lines (not illustrated) and gate lines (not illustrated), and includes pixels which are formed at intersections of the data lines and the gate lines. For example, the display panel 100 may implement pixels by using organic light emitting diodes (OLEDs). Each of the pixels may include an organic light emitting diode and a driving transistor.

Characteristics, such as threshold voltages and a mobility, of the driving transistor and the organic light emitting diode may be different pixel by pixel. When the characteristic of the driving transistor is different pixel by pixel, currents flowing through the driving transistors of the respective pixels may be different from one another even when the same source signal is applied to the respective pixels.

Further, the organic light emitting diode and the driving transistor of each pixel may be degraded with the lapse of a driving time. Due to this fact, a deviation in luminance may occur between the pixels, and as a result, a luminance non-uniformity phenomenon may be caused.

The above-described threshold voltages, mobility and degradations of the driving transistor and the organic light emitting diode of each pixel may be understood as pixel characteristics. Deviations in such pixel characteristics between the pixels may be solved by compensating for values corresponding to the pixel characteristics on image data.

To this end, the source driver 200 is configured to sense pixel signals P1 to Pn from the pixels of the display panel 100 so as to detect the pixel characteristics. The source driver 200 and the display panel 100 may be connected to each other through sensing lines SL1 to SLn which transfer the pixel signals P1 to Pn. For example, the sensing lines SL1 to SLn may be connected to data lines of the display panel 100 or be connected to detection lines (not illustrated) in the display panel 100, depending on a type of the pixels.

By the above description, the source driver 200 may sense the pixel signals P1 to Pn, corresponding to the pixel characteristics of the respective pixels of the display panel 100, through the sensing lines SL1 to SLn.

Also, the source driver 200 may be configured to sense reference signals REF1 to REFm by using some sensing lines SL1 to SLm among the sensing lines SL1 to SLn. The reference signals REF1 to REFm may be understood as reference voltages used to detect characteristics of the source driver 200.

In order to compensate for the pixel characteristics on the image data, the source driver 200 may sense the pixel signals P1 to Pn, corresponding to the pixel characteristics of the respective pixels, transferred through the sensing lines SL1 to SLn from the display panel 100, may convert a sampling signal SAM, corresponding to the pixel signals P1 to Pn, into digital data DOUT, and may provide the digital data DOUT to a timing controller (not illustrated).

For example, the pixel signals P1 to Pn may be used to calculate degradation characteristics of the pixels such as a threshold voltage and a mobility of each driving transistor and a threshold voltage of each organic light emitting diode. Since a pixel current flowing through the organic light emitting diode changes depending on a threshold voltage and a mobility of the driving transistor and a threshold voltage of the organic light emitting diode, the pixel current may be used in calculating values of the above-described pixel characteristics of each pixel. The values of the pixel characteristics of each pixel may be used to compensate for image data.

The source driver 200 may detect the characteristics of the source driver 200 by sensing the reference signals REF1 to REFm in addition to the pixel signals P1 to Pn during a sensing period in which the pixel characteristics of the display panel 100 are detected.

To this end, the source driver 200 may perform sensing the reference signals REF1 to REFm, converting the sampling signal SAM, corresponding to the reference signals REF1 to REFm, into the digital data DOUT and providing the digital data DOUT to the timing controller, during the sensing period after detecting the pixel characteristics of the pixels of the display panel 100, so as to compensate for the characteristics, such as an offset and a gain, of the source driver 200 on the image data.

For example, the characteristics of the source driver 200 including an offset and a gain may change depending on a temperature of a chip or an external factor. In order to compensate for, in real time, the characteristics of the source driver 200, the source driver 200 may sense the reference signals REF1 to REFm transferred through the sensing lines SL1 to SLm after converting the sampling signal SAM, corresponding to the pixel signals P1 to Pm, into the digital data DOUT and outputting the digital data DOUT.

To this end, the source driver 200 may sense the reference signals REF1 to REFm transferred through some sensing lines after starting converting the sampling signal SAM, corresponding to the pixel signals P1 to Pn, into the digital data DOUT, may convert the sampling signal SAM, corresponding to the reference signals REF1 to REFm, into the digital data DOUT after converting the sampling signal SAM, corresponding to the pixel signals P1 to Pn, into the digital data DOUT, and may provide the digital data DOUT to the timing controller.

The timing controller may receive the digital data DOUT in real time, may calculate, in real time, the pixel characteristics and the characteristics of the source driver 200 by using the digital data DOUT, and may compensate for the pixel characteristics and the characteristics of the source driver 200 on the image data.

The display device including the source driver 200 described above may detect the characteristics of the source driver 200 together during the sensing period in which the pixel characteristics of the pixels are detected, thereby accurately detecting, in real time, the characteristics of the source driver 200 that change depending on a temperature and an external factor and accurately compensating for the image data.

The source driver 200 may include a sensing circuit 10 and an analog-to-digital converter 20. The sensing circuit 10 may include a plurality of sensing channels. It may be understood that the plurality of sensing channels correspond to the sensing lines SL1 to SLn. The sensing circuit 10 may sense the pixel signals P1 to Pm or the reference signals REF1 to REFm by using some sensing channels among the plurality of sensing channels, and may sense the pixel signals Pm+1 to Pn by using the remaining sensing channels.

The sensing circuit 10 may provide the sampling signal SAM, corresponding to the pixel signals P1 to Pn or the reference signals REF1 to REFm, to the analog-to-digital converter 20 in a preset order. For example, the sensing circuit 10 may provide the sampling signal SAM, corresponding to the pixel signals P1 to Pn, to the analog-to-digital converter 20, and then, may provide the sampling signal SAM, corresponding to the reference signals REF1 to REFm, to the analog-to-digital converter 20.

The analog-to-digital converter 20 may convert the sampling signal SAM, corresponding to the pixel signals P1 to Pn, into the digital data DOUT and output the digital data DOUT to the timing controller, and then, may convert the sampling signal SAM, corresponding to the reference signals REF1 to REFm, into the digital data DOUT and output the digital data DOUT to the timing controller.

Figure 2:
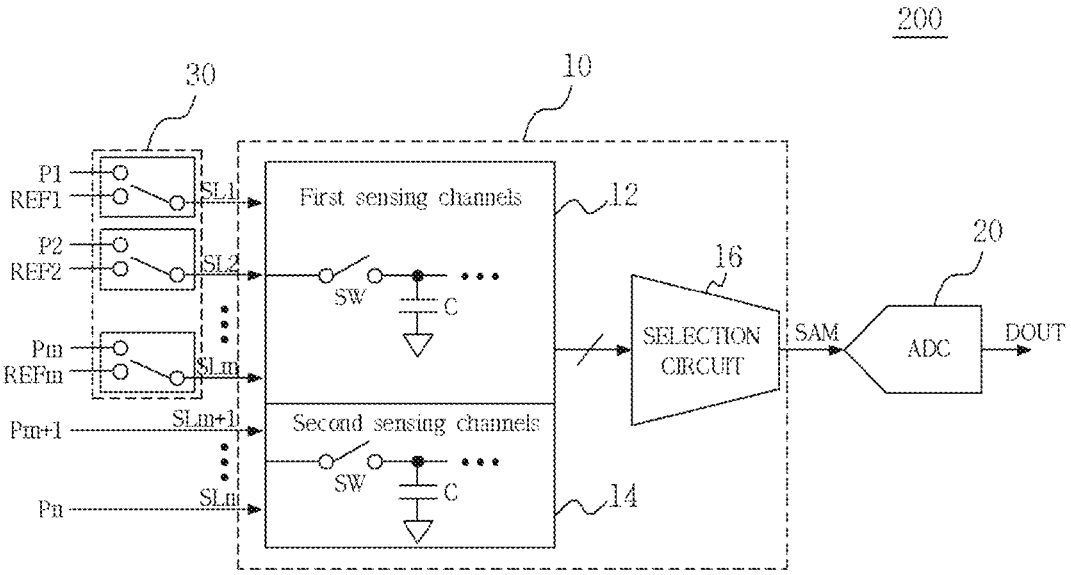
FIG. 2 is a block diagram of a source driver in accordance with an embodiment.

FIG. 2 is a block diagram of the source driver 200 in accordance with an embodiment.

Referring to FIG. 2, the source driver 200 may include a switch circuit 30, the sensing circuit 10 and the analog-to-digital converter 20, and the sensing circuit 10 may include first sensing channels 12, second sensing channels 14 and a selection circuit 16.

The switch circuit 30 may be configured to transfer first pixel signals P1 to Pm or the reference signals REF1 to REFm to the first sensing channels 12 through the sensing lines SL1 to SLm.

The switch circuit 30 may transfer the first pixel signals P1 to Pm to the first sensing channels 12 during the sensing period in which the pixel characteristics are detected, and may transfer the reference signals REF1 to REFm to the first sensing channels 12 during a partial period of the sensing period. The partial period may be set as a partial period after the sampling signal SAM, corresponding to the first pixel signals P1 to Pm, is started to be converted into the digital data DOUT during the sensing period in which the pixel characteristics are detected.

The first sensing channels 12 may sense and hold the first pixel signals P1 to Pm or the reference signals REF1 to REFm transferred through the sensing lines SL1 to SLm from the switch circuit 30. The second sensing channels 14 may sense and hold second pixel signals Pm+1 to Pn transferred through the sensing lines SLm+1 to SLn. For example, each of the first sensing channels 12 and the second sensing channels 14 may include a sample-and-hold circuit. In general, the sample-and-hold circuit may include a sampling switch SW for sampling an input signal and a sampling capacitor C which holds the sampled signal.

Sensing the first pixel signals P1 to Pm by the first sensing channels 12 and sensing the second pixel signals Pm+1 to Pn by the second sensing channels 14 may be successively performed within the same sensing period. In other words, the first sensing channels 12 and the second sensing channels 14 may sequentially sense and hold the pixel signals P1 to Pn of the display panel 100 within the same sensing period.

The selection circuit 16 may sequentially select the first pixel signals P1 to Pm or the reference signals REF1 to REFm, held in the first sensing channels 12, as the sampling signal SAM, and may output the sampling signal SAM to the analog-to-digital converter 20. Further, the selection circuit 16 may select the second pixel signals Pm+1 to Pn, held in the second sensing channels 14, as the sampling signal SAM, and may sequentially output the sampling signal SAM to the analog-to-digital converter 20.

The switch circuit 30 may transfer the reference signals REF1 to REFm to the first sensing channels 12 during the sensing period after the sampling signal SAM corresponding to the first pixel signals P1 to Pm and the second pixel signals Pm+1 to Pn is transferred to the analog-to-digital converter 20.

The first sensing channels 12 and the second sensing channels 14 may be connected to the display panel 100 through the sensing lines SL1 to SLn. The switch circuit 30 may transfer the reference signals REF1 to REFm to the first sensing channels 12 through the some sensing lines SL1 to SLm among the sensing lines SL1 to SLn.

The analog-to-digital converter 20 may convert the sampling signal SAM, outputted from the selection circuit 16, into the digital data DOUT, and may output the digital data DOUT to the timing controller. In this regard, the switch circuit 30 may transfer the reference signals REF1 to REFm to the first sensing channels 12 after the analog-to-digital converter 20 starts to convert the sampling signal SAM, corresponding to the first pixel signals P1 to Pm and the second pixel signals Pm+1 to Pn, into the digital data DOUT.

The analog-to-digital converter 20 may convert the sampling signal SAM into the digital data DOUT in the order of the first pixel signals P1 to Pm, the second pixel signals Pm+1 to Pn and the reference signals REF1 to REFm.

By the above-described embodiment of the present disclosure, the first sensing channels 12 may detect the pixel characteristics from the display panel 100 during the sensing period, and may sense the reference signals REF1 to REFm for detecting the characteristics of the source driver 200, during a second sensing period belonging to the sensing period.

Figure 3:
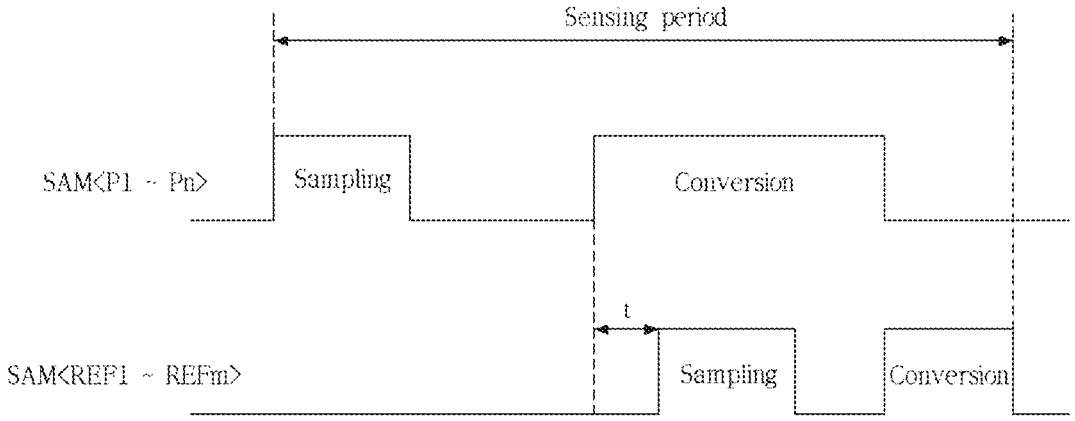
FIG. 3 is a timing diagram of the source driver in accordance with the embodiment.

FIG. 3 is a timing diagram of the source driver 200 in accordance with the embodiment.

The embodiment may operate in a sensing mode in which, during the sensing period, the pixel characteristics of the display panel 100 are detected and the characteristics of the source driver 200 are detected.

For example, the embodiment may operate by being divided into an initialization mode, a programming mode and the sensing mode. The initialization mode may be defined as an operation of initializing pixels, the programming mode may be defined as an operation of programming the pixels with a reference signal after the initialization mode, and the sensing mode may be defined as an operation of sensing the pixel characteristics and the characteristics of the source driver 200 after the programming mode.

FIG. 3 shows the operation of the source driver 200 in the sensing mode after the programming mode, in which the pixel characteristics and the characteristics of the source driver 200 are sensed. A period during which the sensing mode is maintained may be understood as the sensing period.

Referring to FIGS. 1 to 3, the source driver 200 may sense the pixel signals P1 to Pn corresponding to the pixel characteristics of the respective pixels of the display panel 100 through the sensing lines SL1 to SLn, and may sense the reference signals REF1 to REFm by using the some sensing lines SL1 to SLm among the sensing lines SL1 to SLn.

The source driver 200 may sense the pixel signals P1 to Pn, corresponding to the pixel characteristics of the respective pixels, from the display panel 100, may convert the sampling signal SAM, corresponding to the pixel signals P1 to Pn, into the digital data DOUT, and may provide the digital data DOUT to the timing controller.

Moreover, in order to detect the characteristics of the source driver 200, the source driver 200 may sense the reference signals REF1 to REFm, may convert the sampling signal SAM, corresponding to the reference signals REF1 to REFm, into the digital data DOUT, and may provide the digital data DOUT to the timing controller.

The source driver 200 may sense the reference signals REF1 to REFm after a predetermined time t from a time when the sampling signal SAM corresponding to the first pixel signals P1 to Pm is converted into the digital data DOUT.

The source driver 200 may convert the sampling signal SAM, corresponding to the pixel signals P1 to Pn, into the digital data DOUT, may then convert the sampling signal SAM, corresponding to the reference signals REF1 to REFm, into the digital data DOUT, and may output the digital data DOUT to the timing controller.

According to the embodiment of the present disclosure, the source driver 200 may detect the characteristics of the source driver 200 by sensing the reference signals REF1 to REFm during the sensing period in which the pixel characteristics of the pixels of the display panel 100 are detected.

The display device according to the embodiment of the present disclosure including the source driver 200 described above may detect the characteristics of the source driver 200 during a period in which the pixel characteristics of the pixels are detected, thereby accurately detecting, in real time, the characteristics of the source driver 200 that change depending on a temperature and an external factor and thus, accurately compensating for, in real time, the pixel characteristics of the pixels on the image data.

As is apparent from the above description, since the embodiments sense not only pixel characteristics but also characteristics of a source driver by using sensing channels for sensing the pixel characteristics, it is possible to accurately compensate for, on image data, a change in the characteristics of the source driver depending on a temperature.

Also, since the embodiments do not require an additional sensing channel for sensing the characteristics of the source driver, it is possible to reduce a chip area of the source driver.

In addition, the embodiments may eliminate mismatches between pixel sensing channels and channels for sensing the characteristics of the source driver.

What is claimed is:

1. A source driver comprising:

a switch circuit configured to transfer first pixel signals or reference signals;

first sensing channels configured to sense and hold the first pixel signals or the reference signals transferred from the switch circuit;

second sensing channels configured to sense and hold second pixel signals; and a selection circuit configured to output a sampling signal by selecting the first pixel signals of the first sensing channels and the second pixel signals of the second sensing channels, and thereafter, output the sampling signal by selecting the reference signals of the first sensing channels, wherein the switch circuit transfers the reference signals to the first sensing channels after the sampling signal corresponding to the first pixel signals and the second pixel signals is started to be converted into digital data.

2. The source driver according to claim 1, wherein the first sensing channels and the second sensing channels are connected to a display panel through sensing lines, and the switch circuit selectively transfers the first pixel signals and the reference signals to the first sensing channels through some sensing lines among the sensing lines.

3. The source driver according to claim 1, further comprising:

an analog-to-digital converter configured to convert the sampling signal, outputted from the selection circuit, into the digital data.

4. The source driver according to claim 3, wherein the switch circuit transfers the reference signals to the first sensing channels after the analog-to-digital converter starts to convert the sampling signal, corresponding to the first pixel signals and the second pixel signals, into the digital data.

5. The source driver according to claim 4, wherein the analog-to-digital converter converts the sampling signal which is provided in order of the first pixel signals, the second pixel signals and the reference signals, into the digital data.

6. The source driver according to claim 1, wherein the first sensing channels sense the reference signals for detecting characteristics of the source driver, during a sensing period in which pixel characteristics are detected from the display panel and the sampling signal is converted into the digital data.

7. A display device comprising:

a display panel; and a source driver connected to the display panel through sensing lines, wherein the source driver senses first pixel signals and second pixel signals transferred through the sensing lines, and converts the first pixel signals and the second pixel signals into digital data, senses reference signals transferred through the sensing lines after the first pixel signals and the second pixel signals are started to be converted into the digital data, and converts the reference signals into the digital data after the first pixel signals and the second pixel signals are converted into the digital data.

8. The display device according to claim 7, wherein the source driver includes a plurality of sensing channels, and senses the reference signals by using first sensing channels for sensing the first pixel signals, among the plurality of sensing channels.

9. The display device according to claim 7, wherein the source driver senses the reference signals for detecting characteristics of the source driver, during a sensing period in which pixel characteristics are detected from the display panel by sensing the first pixel signals and the second pixel signals.

10. The display device according to claim 7, wherein the source driver comprises:

a switch circuit configured to transfer the first pixel signals or the reference signals;

first sensing channels configured to sense and hold the first pixel signals or the reference signals transferred from the switch circuit;

second sensing channels configured to sense and hold the second pixel signals; and a selection circuit configured to output a sampling signal to be converted into the digital data, by selecting the first pixel signals of the first sensing channels and the second pixel signals of the second sensing channels, and thereafter, output the sampling signal to be converted into the digital data, by selecting the reference signals of the first sensing channels.

11. The display device according to claim 10, wherein the switch circuit transfers the reference signals to the first sensing channels after the sampling signal corresponding to the first pixel signals and the second pixel signals is started to be converted into the digital data.

12. The display device according to claim 10, wherein the switch circuit transfers the reference signals to the first sensing channels through some sensing lines among the sensing lines.

13. The display device according to claim 10, further comprising:

an analog-to-digital converter configured to convert the sampling signal, outputted from the selection circuit, into the digital data.

14. The display device according to claim 13, wherein the analog-to-digital converter converts the sampling signal, corresponding to the first pixel signals and the second pixel signals, into the digital data, and thereafter, converts the sampling signal, corresponding to the reference signals, into the digital data.

15. The display device according to claim 14, wherein the analog-to-digital converter converts the sampling signal into the digital data in order of the first pixel signals, the second pixel signals and the reference signals.

* * * * *